US010661284B2

(12) United States Patent
Lin et al.

(10) Patent No.: US 10,661,284 B2
(45) Date of Patent: May 26, 2020

(54) SHOWERHEAD COMBINATION AND METHOD FOR SWITCHING WATER FLOWING

(71) Applicant: FUJIAN XIHE SANITARY WARE TECHNOLOGY CO., LTD., Nan'an, Fujian (CN)

(72) Inventors: Xiaofa Lin, Nan'an (CN); Xiaoshan Lin, Nan'an (CN); Caibo Gu, Nan'an (CN); Yinan Zheng, Nan'an (CN); Qiqiao Liu, Nan'an (CN); Xiaoqing Deng, Nan'an (CN)

(73) Assignee: FUJIAN XIHE SANITARY WARE TECHNOLOGY CO., LTD., Nan'an (CN)

( * ) Notice: Subject to any disclaimer, the term of this patent is extended or adjusted under 35 U.S.C. 154(b) by 0 days.

(21) Appl. No.: 15/206,907

(22) Filed: Jul. 11, 2016

(65) Prior Publication Data

US 2017/0259279 A1 Sep. 14, 2017

(30) Foreign Application Priority Data

Mar. 8, 2016 (CN) ..... 2016 1 0129749

(51) Int. Cl.
*B05B 1/18* (2006.01)
*B05B 15/65* (2018.01)
*B05B 1/16* (2006.01)

(52) U.S. Cl.
CPC ..... *B05B 1/185* (2013.01); *B05B 1/16* (2013.01); *B05B 1/18* (2013.01); *B05B 15/65* (2018.02)

(58) Field of Classification Search
CPC .. B05B 1/185; B05B 1/16; B05B 1/18; B05B 15/65
USPC ..... 239/443–449, DIG. 11
See application file for complete search history.

(56) References Cited

U.S. PATENT DOCUMENTS 8,919,379 B2 * 12/2014 Zhou ..... B05B 1/1618 137/625.48
2007/0158460 A1 7/2007 Lev

FOREIGN PATENT DOCUMENTS

| | | | |
|---|---|---|---|
| CN | 101218035 | A | 7/2008 |
| CN | 101862713 | A | 10/2010 |
| CN | 103140155 | A | 6/2013 |
| CN | 203322457 | U | 12/2013 |
| CN | 103486318 | A | 1/2014 |

(Continued)

*Primary Examiner* — Christopher S Kim
(74) *Attorney, Agent, or Firm* — Cooper Legal Group, LLC

(57) ABSTRACT

A showerhead combination includes a first showerhead that is non-handheld; a second showerhead that is handheld; and a control device that includes a switching mechanism and a magnetic control unit that is movably installed within the first showerhead to control when water flows out of the first showerhead. The second showerhead cooperates with the first showerhead so that, when the second showerhead is connected to the first showerhead, the connection drives the control device to cause water to flow out from the first showerhead, and, when the second showerhead is disconnected from the first showerhead, the control device causes the first showerhead to stop the water flow. A method for controlling water flow includes connecting the second showerhead to the first showerhead to cause water to flow from the first showerhead; and disconnecting the second showerhead from the first showerhead to cause water to stop water from flowing therefrom.

18 Claims, 9 Drawing Sheets

(56) References Cited

FOREIGN PATENT DOCUMENTS

| | | | |
|---|---|---|---|
| CN | 103521369 | A | 1/2014 |
| CN | 104475279 | A | 4/2015 |
| CN | 205413398 | U | 8/2016 |
| DE | 2513737 | A1 | 10/1975 |

* cited by examiner

SHOWERHEAD COMBINATION AND METHOD FOR SWITCHING WATER FLOWING

FIELD OF THE INVENTION

The present invention relates to sanitary products, and more particularly related to a showerhead combination and a method for switching water flowing.

BACKGROUND OF THE INVENTION

The showerhead combination normally includes a handheld shower and a non handheld shower (including head shower or wall-hanging shower), presently, the showerhead combination in prior art is normally in two kinds: one kind is totally using mechanical switch mechanism to control the water outlet of non handheld shower or not, the outlet status is irrelevant to the connection between the handheld shower and the non handheld shower, when water outlet is needy from both shower, that will be necessary to operate each shower's switch mechanism, therefore, the operation of this kind of showerhead combination is more complicated, and not friendly for human using; the other kind is using gravity switch function, through hanging the handheld shower or not to make the switch function, but this kind of showerhead combination will not make two kinds of shower water outlet synchronously.

SUMMARY OF THE INVENTION

The present invention is provided with a showerhead combination and a method of water flowing control to overcome the disadvantages of existing structure in prior art.

One technical solution to the above technical problems for the present invention is that:

a showerhead combination comprises a non handheld first showerhead, a handheld second showerhead, and a control device. The control device is installed in the first showerhead to control the water flowing out of the first showerhead. The second showerhead is cooperated with the first showerhead in two different statuses. In one status, the second showerhead is connected to the first showerhead and drives the motion of the control device to make water flowing out of the first showerhead. In the other status, the second showerhead is separated from the first showerhead, and the control device controls the first showerhead to stop water flowing.

In another preferred embodiment, said control device comprises a switch mechanism and a magnetic control unit, the switch mechanism is installed in the first showerhead, the magnetic control unit is movably installed in the first showerhead; Said second showerhead is disposed with a first magnetic piece, when the second showerhead being connected to the first showerhead, the first magnetic piece will be magnetically attracted by the magnetic control unit and drive the magnetic control unit to move, then the magnetic control unit will drive the motion of the switch mechanism to control the water outlet of the first showerhead, when the second showerhead being separated to the first showerhead, resetting of the magnetic control unit will drive the motion of the switch mechanism to control the first showerhead to stop water flowing.

In another preferred embodiment, said control device is an optical induction control device or an infrared induction control device or an electric switch control device triggered by the second showerhead or a mechanical control device triggered by the second showerhead.

In another preferred embodiment, said control device comprises a control lever, a switch board and a switch mechanism, the switch mechanism is installed in the first showerhead, the switch board is movably installed in the first showerhead with connection to the switch mechanism, the control lever is in rotation connection to the first showerhead, when the second showerhead being connected to the first showerhead, the second showerhead will urge the control lever to rotate, then the control lever drives the motion of the switch mechanism through the switch board to control the water outlet of the first showerhead, when the second showerhead being separated to the first showerhead, resetting of the switch board will drive the motion of the switch mechanism to control the first showerhead to stop water flowing out.

In another preferred embodiment, said switch mechanism is a pilot valve switch mechanism with inlet hole and outlet hole, the switch mechanism is installed in said first showerhead, as well as with its inlet hole and outlet hole respectively connected to the inlet end and outlet end of the first showerhead.

In another preferred embodiment, said magnetic control unit comprises a switch board and a second magnetic piece which could be magnetically attracted to the first magnetic piece, the second magnetic piece is installed on the switch board, the switch board is movably fixed to said first showerhead, and connected to said switch mechanism; the first showerhead is also disposed with a resetting mechanism to drive the magnetic control unit to reset.

In another preferred embodiment, said switch mechanism comprises: a fixing unit, with said inlet hole and outlet hole set on it, also is disposed with a first outlet channel, a second outlet channel and a pressure relief hole, the first outlet channel and the second outlet channel are connected to the same said outlet hole or respectively connected to one said outlet hole, the inlet hole could be communicated with first outlet channel, the pressure relief hole could be communicated with second outlet channel; a movable valve core, which is sliding connected in the fixing unit along the water inlet direction, as well as cooperated with the fixing unit to form a pressure cavity, the movable valve core is also disposed with some pores communicating with the inlet hole, the pores and the pressure relief hole are both communicated with the pressure cavity; a switch pole, which movably inserts in the pressure relief hole of the fixing unit, as well as through its axial movement to open or close the pressure relief hole, the outer end of the switch pole is connected to said magnetic control unit, the switch pole controls the water pressure inside the pressure cavity by the way of opening or closing the pressure relief hole, then drives the movable valve core to slide for opening or closing said inlet hole.

In another preferred embodiment, said switch mechanism also comprises a first elastic piece, which is set in said pressure cavity, and is located between said movable valve core and the fixing unit to push against each other.

In another preferred embodiment, said first showerhead comprises a shower body and an outlet assembly, the inlet end of the first showerhead is set in the shower body, while the outlet end is set in the outlet assembly; said switch mechanism is installed in the shower body; said magnetic control unit is movably set on the outlet assembly.

In another preferred embodiment, said resetting mechanism comprises at least one second elastic piece, which is located between said magnetic control unit and the outlet assembly to push against each other.

In another preferred embodiment, said second showerhead comprises a handheld portion and an outlet head portion, the outlet head portion is in annular shape, and is coupled to said outlet assembly, said first magnetic piece is set in the outlet head portion.

In another preferred embodiment, said outlet assembly comprises an inlet plate, a diverter plate and a face cover assembly with at least two water outlet function, the inlet plate is provided with an inlet aperture connected to said switch mechanism, the inlet plate and the diverter plate are fixed to each other in up and down way to form a water-through cavity communicating with the inlet aperture, the face cover assembly is connected to the diverter plate in rotation way, the rotation of the face cover assembly with respect to the diverter plate makes the water outlet function change in switch manner; said magnetic control unit is movably set on the inlet plate.

In another preferred embodiment, said first showerhead is disposed with a diverter assembly, which comprises a main inlet hole communicating with the inlet end of the first showerhead, and a first diverter hole and a second diverter hole, the first diverter hole is connected to said switch mechanism to supply water to the switch mechanism; the second diverter hole is connected to said second showerhead through an inlet tube; the second showerhead is provided with a control mechanism to control its water outlet.

A method of controlling water flowing in a showerhead combination is provided. The showerhead combination comprises a non handheld first showerhead and a handheld second showerhead. When connecting the second showerhead to the first showerhead, the first showerhead will be with water outlet, when dispatching the second showerhead from the first showerhead, the first showerhead will stop water flowing.

In another preferred embodiment, said second showerhead is provided with a control device, when connecting the second showerhead to the first showerhead, the second showerhead will drive the motion of the control device to control the water outlet of the first showerhead, when dispatching the second showerhead from the first showerhead, the control device will control the first showerhead to stop water flowing.

In another preferred embodiment, said control device comprises a switch mechanism and a magnetic control unit, the switch mechanism is installed in the first showerhead, the magnetic control unit is movably installed in the first showerhead;

Said second showerhead is disposed with a first magnetic piece, when connecting the second showerhead to the first showerhead, the first magnetic piece will be magnetically attracted by the magnetic control unit and drive the magnetic control unit to move, then the magnetic control unit will drive the motion of the switch mechanism to control the water outlet of the first showerhead, when dispatching the second showerhead being from the first showerhead, resetting of the magnetic control unit will drive the motion of the switch mechanism to control the first showerhead to stop water flowing.

Comparing to the existing known technology, the technical solution of the present invention has advantages as follows:

1. The invention by setting said control device in the first showerhead, and making the second showerhead and the first showerhead cooperating with each other in two status, one status being that the second showerhead connected to the first showerhead and driving the motion of the control device to make water outlet of the first showerhead, the other status being that the second showerhead separated from the first showerhead, the control device controlling the first showerhead to stop water flowing, so that the invention only need to connect the second showerhead to the first showerhead, the first showerhead will be controlled with water outlet, while dispatch the second showerhead being from the first showerhead, the first showerhead will stop water flowing, therefore, the operation of the invention is more convenient and more friendly for human use, as well as with synchronous water outlet from two kinds of showers;
2. Said control device is preferably comprising a switch mechanism and a magnetic control unit, cooperating with the first magnetic piece set on the second showerhead to accomplish the function in switch manner, not only with traits of convenience in operation, friendly in human using, with both showers water outlet in the same time, but also with advantages of simple structure, lower cost, easy assembly, stable during work, long service life, strong anti-interference capability and so on;
3. Said switch mechanism is preferably using pilot valve switch mechanism, which is characterized in small operation force required and operation more stable, and lower requirement of magnetic attraction ability for the magnetic control unit and the first magnetic piece, so it is easy to design the magnetic control unit and the first magnetic piece; Moreover, the pilot valve switch mechanism also fix the problem of big abrasion and easy failure under high water pressure when using gravity switching showerhead combination;
4. Said outlet head portion is in annular shape, and is coupled to said outlet assembly, so that two kinds of showers could be combined in perfect shape to feel more unitary and aesthetics by user;
5. The outlet assembly of the first showerhead comprises an inlet plate, a diverter plate and a face cover assembly with at least two water outlet function, the rotation of the face cover assembly with respect to the diverter plate makes the water outlet function change in switch manner, so that function of the showerhead combination of the invention is more affluent to satisfy the need of users.

The present invention will be further described with following drawings and the embodiments to make the present invention more clear and well-known, the embodiments of the showerhead combination of the present invention is used to describe the present invention but not to limit the scope of the present invention.

DETAILED DESCRIPTION OF THE EMBODIMENTS

Embodiment 1

Figure 1:
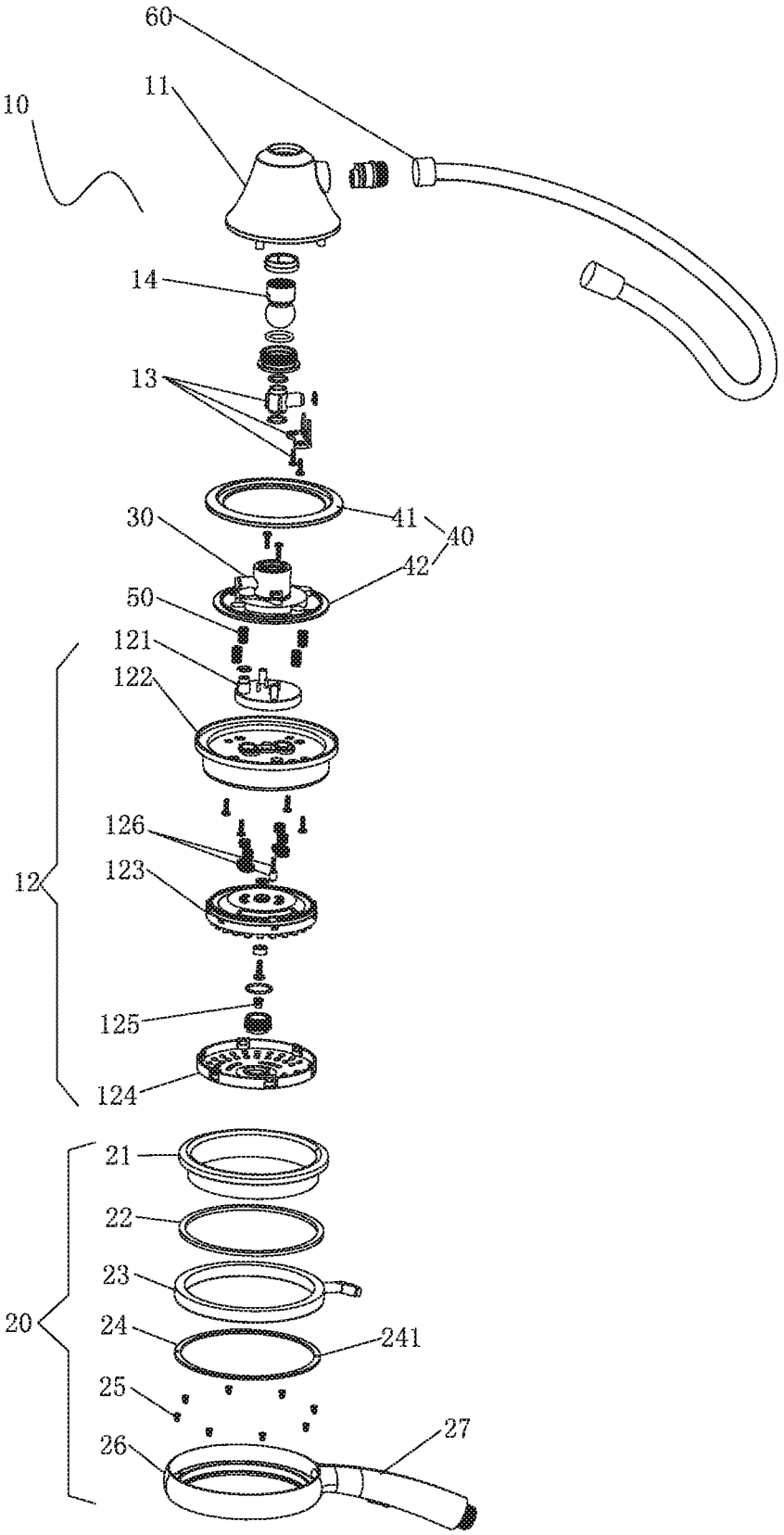
FIG. 1 illustrates an exploded and schematic diagram of the present invention in embodiment 1.
Figure 2:
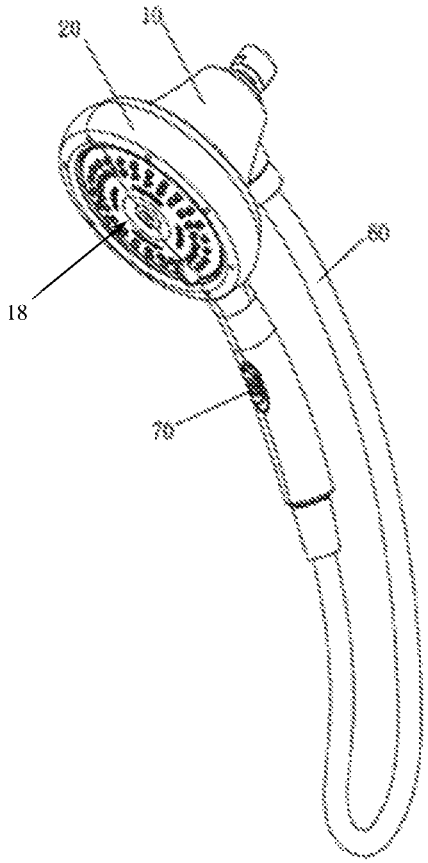
FIG. 2 illustrates a stereo structure schematic diagram of the present invention in embodiment 1 (the second showerhead connected to the first showerhead)
Figure 3:
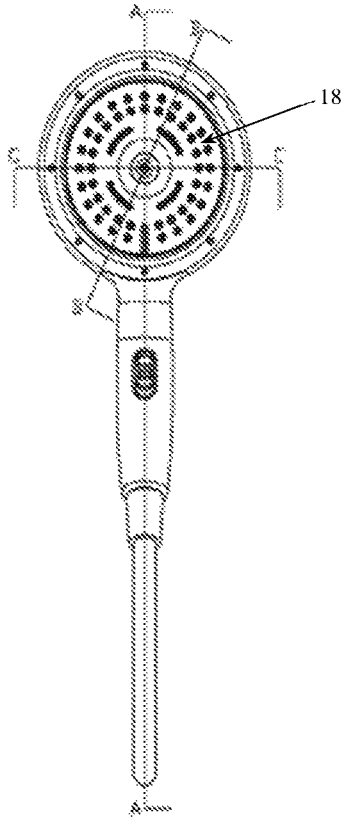
FIG. 3 illustrates a front view of the present invention in embodiment 1
Figure 4:
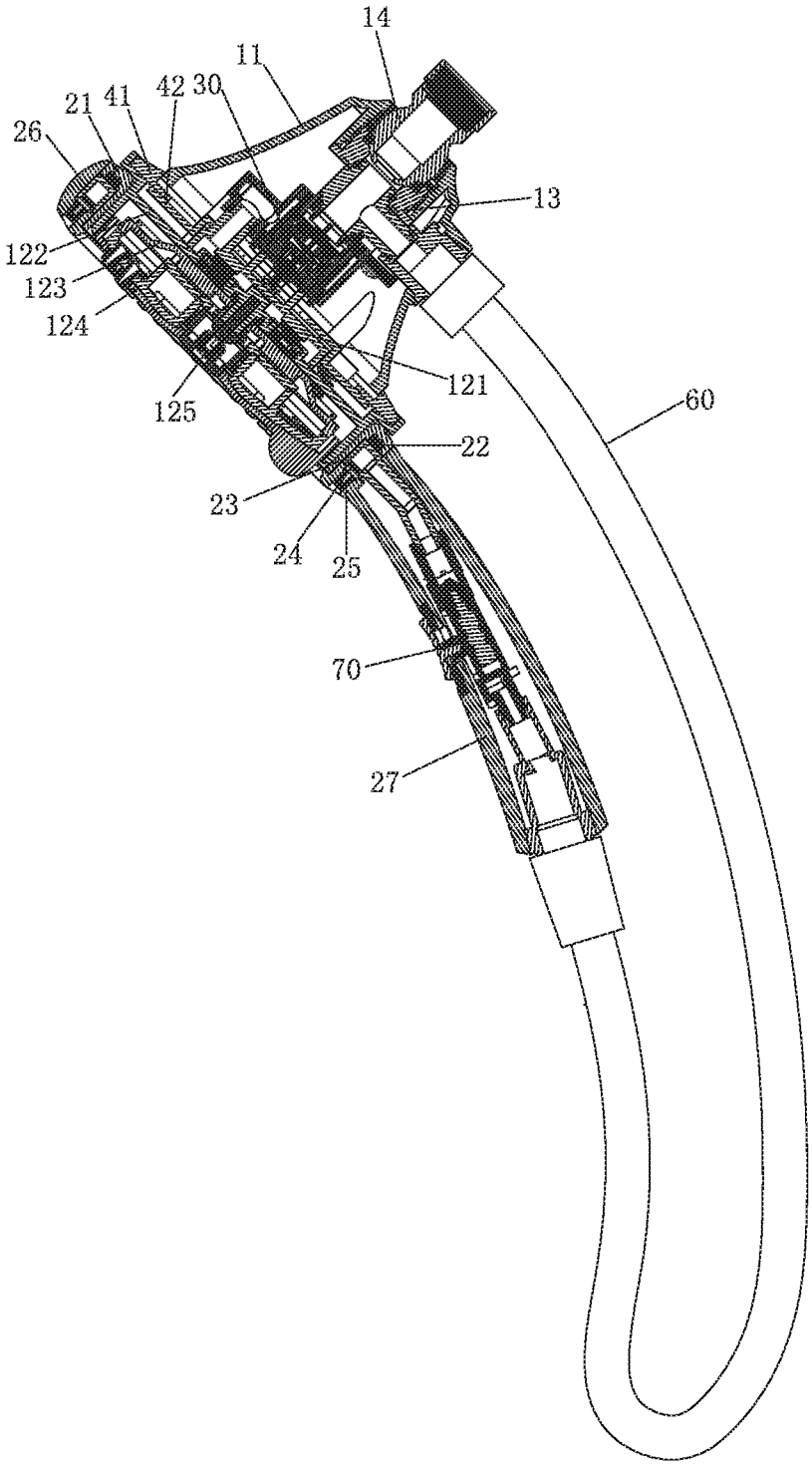
FIG. 4 illustrates an A-A sectional diagram of the present invention in embodiment 1.

Please referring to FIGS. 1-9, a showerhead combination of the invention, comprises a non handheld first showerhead 10 and a handheld second showerhead 20, the first showerhead 10 is specifically set to be a head shower, moreover, it could be wall-hanging shower or other non handheld shower. The invention also comprises a control device, the control device being installed in the first showerhead 10 to control the water outlet of the first showerhead 10 or not; the second showerhead 20 being cooperated with the first showerhead 10 in two different status, one status being that the second showerhead 20 connected to the first showerhead 10 and driving the motion of the control device to make water outlet of the first showerhead 10, the other status being that the second showerhead 20 separated from the first showerhead 10, the control device controlling the first showerhead 10 to stop water flowing. Said first showerhead 10 comprises a shower body 11 and an outlet assembly 12, the shower body 11 is set to be the shape like trumpet, the inlet end of the first showerhead 10 is set in the shower body 11, while the outlet end is set in the outlet assembly 12. Said second showerhead 20 comprises a handheld portion 27 and an outlet head portion, the outlet head portion is in annular shape, and is coupled to said outlet assembly 12.

In this embodiment, said control device specifically comprises:

- a switch mechanism 30, which is installed in the first showerhead 10, to control the water outlet of the first showerhead 10 or not;
- a magnetic control unit 40, which is movably installed in the first showerhead 10, to coordinate the motion of said switch mechanism 30.

Said second showerhead 20 is disposed with a first magnetic piece 22, when the second showerhead 20 being connected to the first showerhead 10, the first magnetic piece 22 will be magnetically attracted by the magnetic control unit 40 and drive the magnetic control unit 40 to move, then the magnetic control unit 40 will drive the motion of the switch mechanism 30 to control the water outlet of the first showerhead 10, when the second showerhead 20 being separated to the first showerhead 10, resetting of the magnetic control unit 40 will drive the motion of the switch mechanism 30 to control the first showerhead 10 to stop water flowing.

In this embodiment, said switch mechanism 30 is a pilot valve switch mechanism with inlet hole 30*a* and outlet hole 30*b*, the switch mechanism 30 is installed in said first showerhead 10, as well as with its inlet hole 30*a* and outlet hole 30*b* respectively connected to the inlet end and outlet end of the first showerhead 10. In this embodiment, said magnetic control unit 40 comprises a switch board 42 and a second magnetic piece 41 which could be magnetically attracted to the first magnetic piece 22, the second magnetic piece 41 is installed on the switch board 42, the switch board 42 is movably fixed to said first showerhead 10, and connected to said switch mechanism 30; the first showerhead 10 is also disposed with a resetting mechanism to drive the magnetic control unit 40 to reset.

Figure 7:
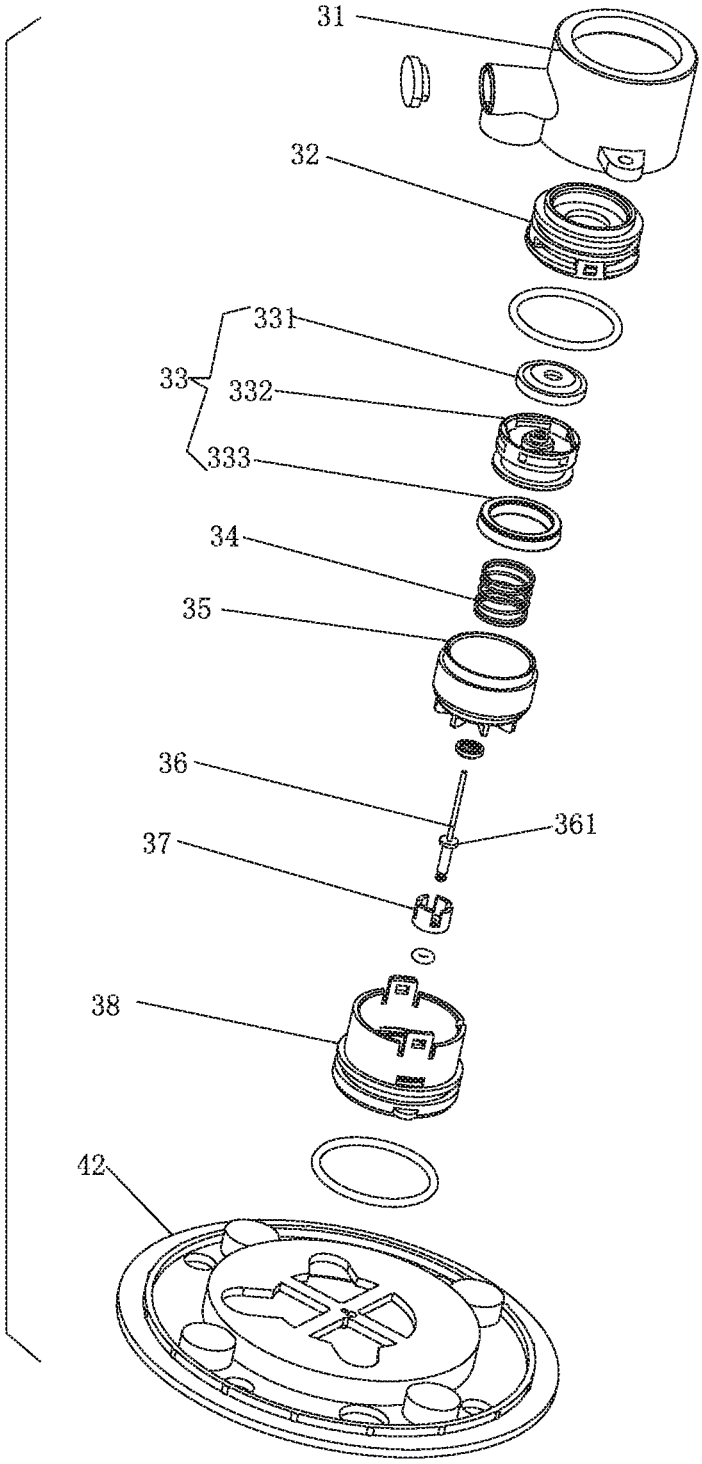
FIG. 7 illustrates an exploded and schematic diagram of the switch mechanism of the present invention in embodiment 1 (including switch board)
Figure 8:
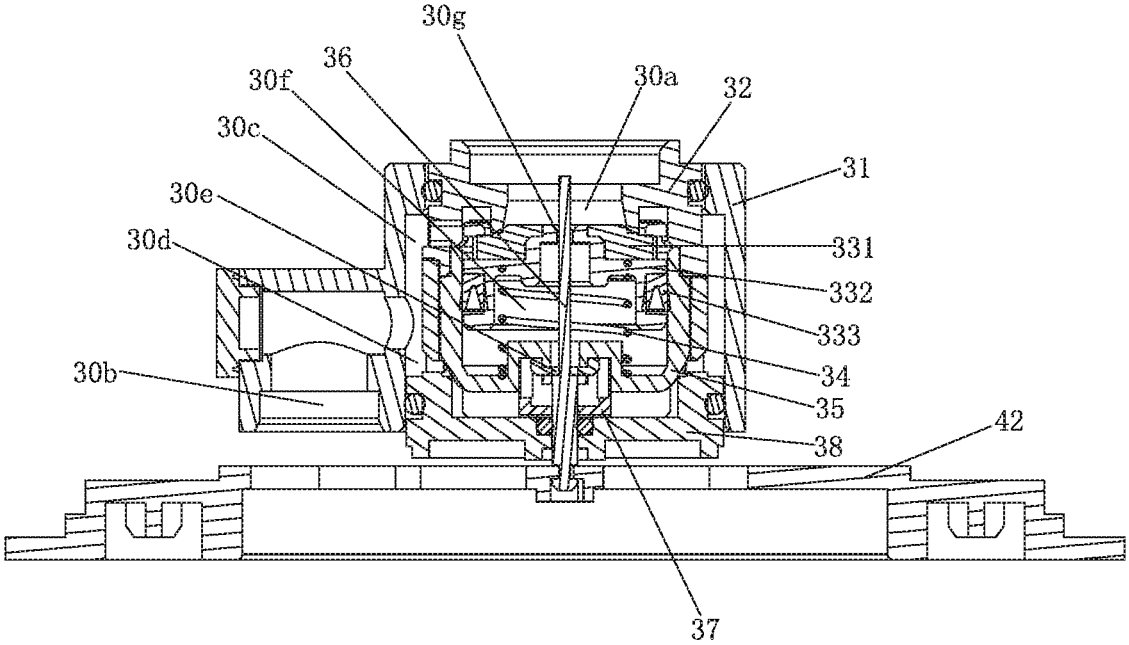
FIG. 8 illustrates a sectional diagram of the switch mechanism in stop water flowing status of the present invention in embodiment 1.
Figure 9:
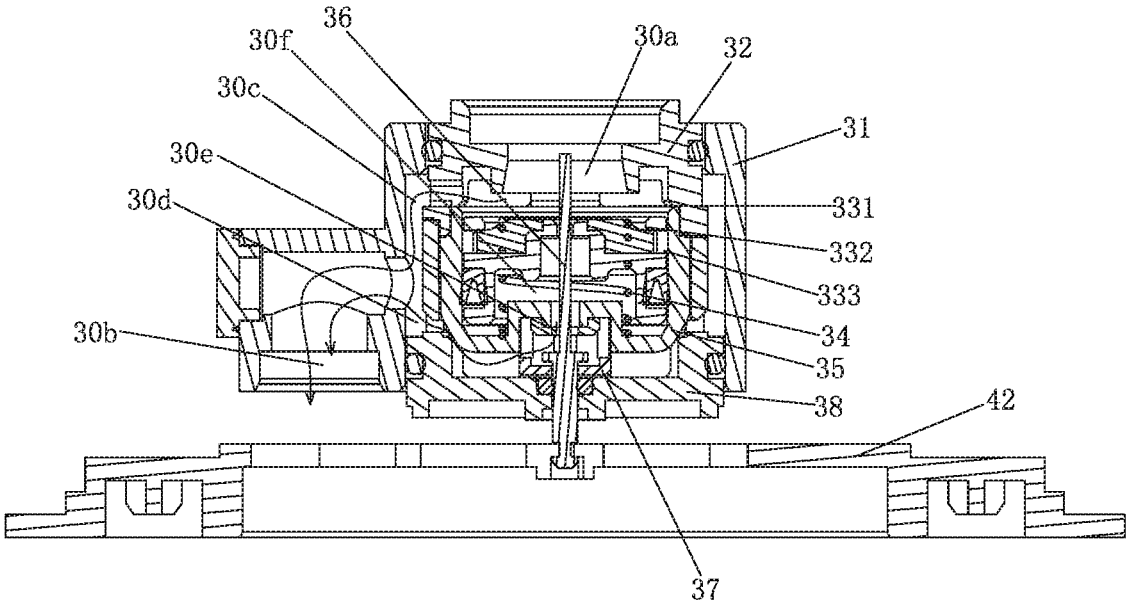
FIG. 9 illustrates a sectional diagram of the switch mechanism in water outlet status of the present invention in embodiment 1.

Referring to FIG. 7, FIG. 8, said switch mechanism 30 specifically comprises: A fixing unit, with said inlet hole 30*a* and outlet hole 30*b* set on it, also is disposed with a first outlet channel 30*c*, a second outlet channel 30*d* and a pressure relief hole 30*e*, the first outlet channel 30*c* and the second outlet channel 30*d* are connected to the same said outlet hole 30*b* (or, the first outlet channel 30*c* and the second outlet channel 30*d* respectively connected to one said outlet hole 30*b*), the inlet hole 30*a* could be communicated with first outlet channel 30*c*, the pressure relief hole 30*e* could be communicated with second outlet channel 30*d;*

A movable valve core 33, which is sliding connected in the fixing unit along the water inlet direction, as well as cooperated with the fixing unit to form a pressure cavity 30*f*, the movable valve core 33 is also disposed with some pores 30*g* communicating with the inlet hole 30*a*, the pores 30*g* and the pressure relief hole 30*e* are both communicated with the pressure cavity 30*f;*

A switch pole 36, which movably inserts in the pressure relief hole 30*e* of the fixing unit, as well as through its axial movement to open or close the pressure relief hole 30*e*, the outer end of the switch pole 36 is connected to said magnetic control unit 40, the switch pole 36 controls the water pressure inside the pressure cavity 30*f* by the way of opening or closing the pressure relief hole 30*e*, then drives the movable valve core 33 to slide for opening or closing said inlet hole 30*a*.

Said fixing unit specifically comprises a valve body 31, an upper cover 32, a fixing base 35, a base 38 and a locating sleeve 37, the upper cover 32 is fixed with the base 38 in up and down way and wholly installed in the valve body 31, the upper cover 32 is disposed with said inlet hole 30*a* and is cooperated with the valve body 31 and the base 38 to form said first outlet channel 30*c*, the base 38 is cooperated with the valve body 31 to form said second outlet channel 30*d*, the valve body 31 is disposed with said outlet hole 30*b*. The fixing base 35 is fixed in the cavity enclosed by the upper cover 32 and the base 38 by the locating sleeve 37, and the fixing base 35 is disposed with said pressure relief hole 30*e*. Said movable valve core 33 comprises a movable block 332, sealing cushion 331 and V-shape ring 333, the sealing cushion 331 is coupled to the movable block 332 to open or close said inlet hole 30*a*, the V-shape ring 333 is coupled to the movable block 332 to seal the space between the movable block 332 and the fixing base 35, in order to make the movable block 332 enclose with the fixing base 35 to form said pressure cavity 30*f*. The upper end of said the switch pole 36 passes through the base 38, the locating sleeve 37 and the pressure relief hole 30*e* of the fixing base 35 in turn then goes into said pressure cavity 30*f*. Center of the movable block 332 is disposed with through hole, the upper end of said the switch pole 36 passes through the through hole and generates gap between through hole to form said pores 30*g*. Center sidewall of said movable block 332 is disposed with a blocking portion 361, specifically, the blocking portion 361 is set to be an annular convex table and is located on the outer side of the pressure relief hole 30*e* to open or close the pressure relief hole 30*e*. Between said switch pole 36 and the base 38 is accompanied with a sealing ring. The outer end of switch pole 36 is stuck connected to said switch board 42.

Said switch mechanism 30 also comprises a first elastic piece 34, the first elastic piece 34 is set in said pressure cavity 30*f*, and is located between said movable valve core 33 and the fixing unit to push against each other, specifically, the first elastic piece 34 is a spring, which is coupled out of said switch pole 36, located between the movable block 332 and the fixing base 35 to push against each other.

Figure 5:
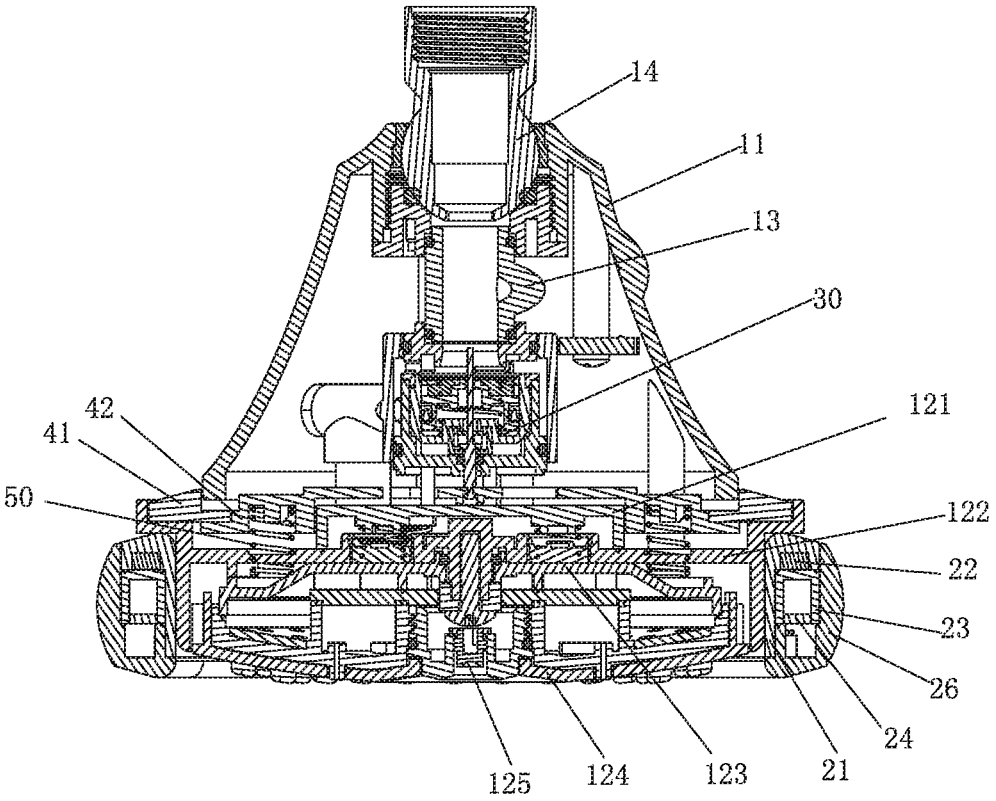
FIG. 5 illustrates a B-B sectional diagram of the present invention in embodiment 1.
Figure 6:
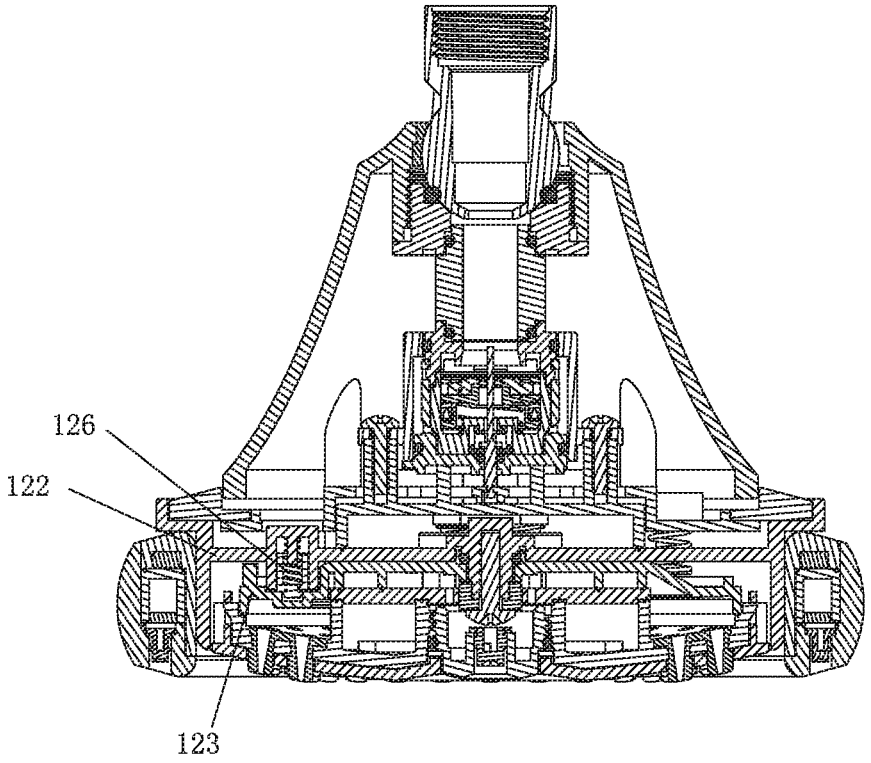
FIG. 6 illustrates a C-C sectional diagram of the present invention in embodiment 1.

As FIG. 5 shown, when the switch mechanism 30 stopping water inlet, the blocking portion 361 set in the center of the switch pole 36 would block the pressure relief hole 30*e*, to make the second outlet channel 30*d* to be unable to communicated with the pressure relief hole 30*e*, so that the pores 30*g* of the movable valve core 33 would be always in the water going through status, therefore the water pressure in the pressure cavity 30*f* will be kept in balance with the water pressure of inlet hole 30*a*, so that the movable valve core 33 will block said inlet hole 30*a* by the pushing force from the first elastic piece 34, therefore the first outlet channel 30*c* couldn't communicate with the inlet hole 30*a*. When the switch board 42 urging the switch pole 36 to move downwardly to make the blocking portion 361 to open the pressure relief hole 30*e*, the first outlet channel 30*c* will communicate with the pressure relief hole 30*e*, the water pressure in the pressure cavity 30*f* will release through the pressure relief hole 30*e*, to make the water pressure in the pressure cavity 30*f* less than the water pressure of inlet hole 30*a*, so that the movable valve core 33 will be quickly pressed down by inlet water, then would open the inlet hole 30*a* and compress the first elastic piece 34, to make the first outlet channel 30*c* communicate with the inlet hole 30*a*, as FIG. 6 shown, at this time, the first outlet channel 30*c* and the second outlet channel 30*d* are both with water outlet, then two stands of water will converge before flowing out of said outlet hole 30*b*.

In this embodiment, said switch mechanism 30 is specifically installed in the shower body 11 of the first showerhead, said magnetic control unit 40 is movably set on the outlet assembly 12 of the first showerhead, said resetting mechanism comprises at least one second elastic piece 50, the second elastic piece 50 is specifically set to be a spring, which is located between said magnetic control unit 40 and the outlet assembly 12 to push against each other. Said first magnetic piece 22 is set in the outlet head portion of the second showerhead 20. The outlet head portion of the second showerhead 20 specifically comprises an annular back cover 21, an inner bracket 23, an annular dispersion board 24 and an annular front cover 26, the handheld portion 27 is integrally molded at the side of the front cover 26, said first magnetic piece 22 is set in the back cover 21, and the back cover 21 and the front cover 26 are fixed together; the inner bracket 23 is disposed with an annular water groove whose notch is set downwardly, the dispersion board 24 is connected to the notch of the annular water groove set on the inner bracket 23, the dispersion board 24 is also provided with several lower water holes 241 communicating with the annular water groove; the inner bracket 23 is installed in the cavity enclosed between the back cover 21 and the front cover 26, and side of the inner bracket 23 is disposed with a water-through channel communicating with the annular water groove, the water-through channel is connected to the water-through tubes set in the handheld portion 27. The front cover is used for water outlet, the front cover is disposed with plural water outlet holes and is cooperated with the inner bracket 23 to enclose an annular water outlet cavity, the plural water outlet holes and the lower water holes 241 are respectively connected to the annular water outlet cavity, and dispersion valve core 25 is installed in each water outlet hole.

In this embodiment, said outlet assembly 12 comprises an inlet plate 121, a diverter plate 122 and a face cover assembly with at least two water outlet function, the inlet plate 121 is provided with an inlet aperture connected to said outlet hole 30*b*, the inlet plate 121 and the diverter plate 122 are fixed to each other in up and down way to form a water-through cavity communicating with the inlet aperture, the face cover assembly is connected to the diverter plate 122 in rotation way, the rotation of the face cover assembly with respect to the diverter plate 122 makes the water outlet function change in switch manner; said magnetic control unit 40 is movably set on the inlet plate 121. Said cover assembly specifically comprises an outlet assembly 123 and an outer cover 124, the outlet assembly 123 and the outer cover 124 are connected to each other in rotation way, the outer cover 124 is disposed with a center outlet hole (which is set with the dispersion valve core 125), a first group of outlet holes annularly set on the peripheral area of the center outlet hole, and a second group of outlet holes annularly set on the peripheral area of the first group of outlet holes, the outlet assembly 123 and the outer cover 124 are fixed to each other in up and down way to form three water outlet cavities respectively corresponding to the center outlet hole, the first group of outlet holes and the second group of outlet holes. The outlet assembly 123 through its own rotation with respect to the diverter plate 122 makes all of or part of the three water outlet cavities with water inlet to accomplish the outlet function in switch manner. There is a spring bead 126 set between the outlet assembly 123 and the outer cover 124, in order to enhance the feeling of rotating by hands as well as to provide notice of on position or not. The outlet head portion of the second showerhead 20 is detachably coupled out of the diverter plate 122. The center outlet hole, the first group of outlet holes and the second group of outlet holes form a first water outlet end 18.

In this embodiment, a diverter assembly 13 is installed in the shower body 11 of the first showerhead, the diverter assembly 13 is provided with a main inlet hole 30*a* communicating the inlet end of the first showerhead 10, and a first diverter hole as well as a second diverter hole, the first diverter hole is connected to the inlet hole 30*a* of said switch mechanism 30 to supply water to the switch mechanism 30; the second diverter hole is connected to the second showerhead 20 through the inlet tube 60. Therefore, water is divided into two ways after going into the diverter assembly 13, one way is for supplying water to the first showerhead 10, the other way is for supplying water to the second showerhead 20. The second showerhead 20 is provided with a control device 70 for controlling the water outlet or not, specifically, the control device 70 is a button control mechanism, which is installed on the handheld portion 27 of the second showerhead 20. Top end of the shower body 11 of the first showerhead 11 is disposed with an inlet ball head 14, the inlet ball head 14 is connected to the main inlet hole 30*a* of the diverter assembly, by rotating the first showerhead 10 through the inlet ball head 14 to regulate the spray angle of the first showerhead 10.

In this embodiment, peripheral surface of said dispersion valve core 25,125 is annularly disposed with plural outlet grooves set in interval, the outlet grooves are set in gradient angle on the peripheral surface of the dispersion valve core. Due to a guiding angle existing on the outlet grooves, when water leaving certain distance from the outlet grooves, water outlet of each outlet grooves will converge together to shape an annular trumpet opening, when water injecting out of certain distance, due to the impact and centrifugal force of water, to make the annular water from the annular trumpet opening start to disperse evenly, to generate annular dispersion, the annular dispersion is with double effect combining shower spray and nebulization spray, to accomplish natural outlet status like waterfall swooping with water splashing.

In this embodiment, said first magnetic piece 22 and the second magnetic piece 41 are set to be magnet with annular shape.

Figure 10:
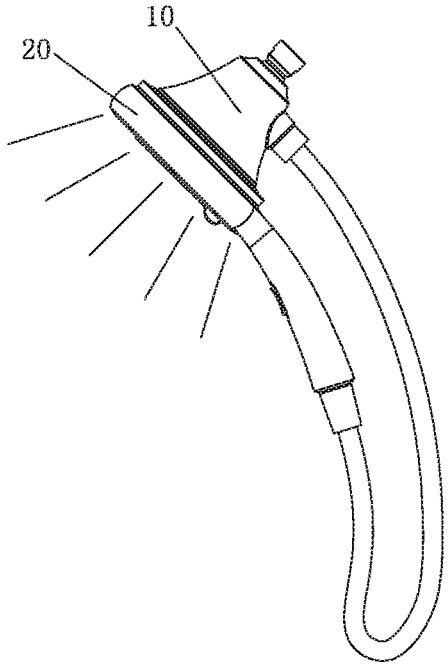
FIG. 10 illustrates a state diagram of the present invention in embodiment 1 when the first showerhead and the second showerhead are both with water outlet.
Figure 11:
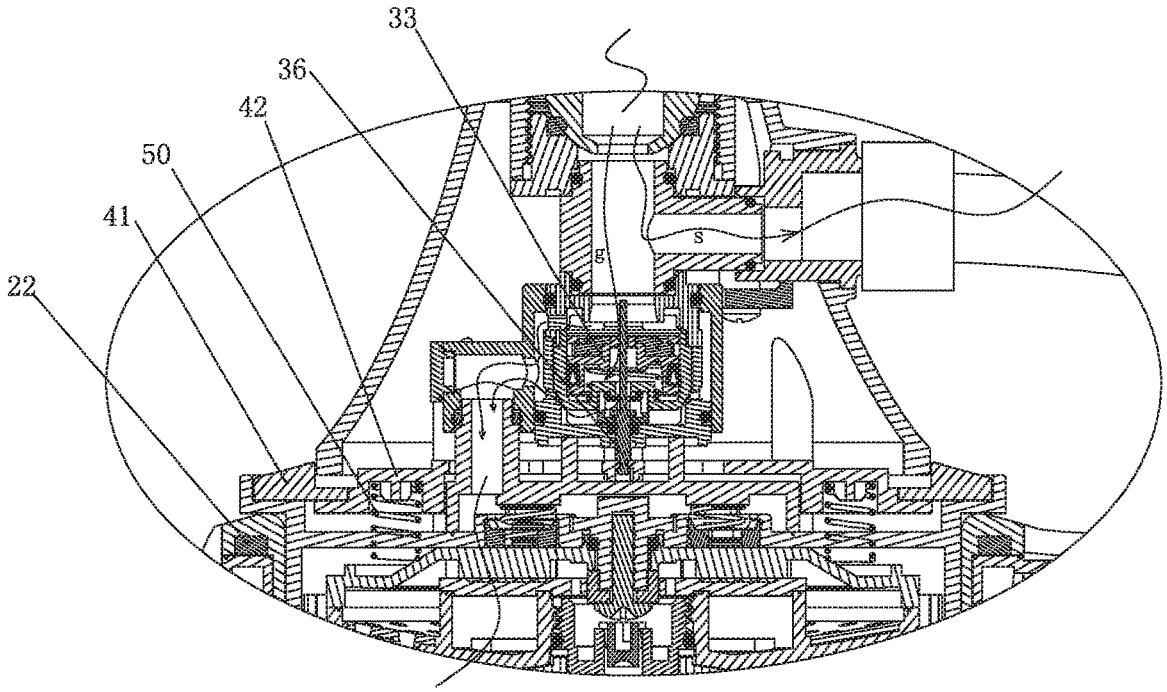
FIG. 11 illustrates a partial sectional diagram of the present invention in embodiment 1 when the first showerhead and the second showerhead are both with water outlet.

During using process, couple the outlet head portion of the second showerhead 20 to the diverter plate 122 of the first showerhead 10, the first magnetic piece 22 magnetically attracts the second magnetic piece 41, one side, to make the second showerhead 20 tightly fix on the first showerhead 10, another side, to make the second magnetic piece 41 and the switch board 42 move downwardly, compress the second elastic piece 50 and urge the switch pole 36 to move downwardly for opening the pressure relief hole 30*e*. After opening of the pressure relief valve 30*e*, the water pressure of the pressure cavity 30*f* is released through the pressure relief valve 30*e*, to make the water pressure in the pressure cavity 30*f* less than the water pressure of inlet hole 30*a*, so that the movable valve core 33 will be quickly pressed down by inlet water, then would open the inlet hole 30*a* and compress the first elastic piece 34, to make the first outlet channel 30*c* communicate with the inlet hole 30*a*, at this time, the first outlet channel 30*c* and the second outlet channel 30*d* are both with water outlet, then two stands of water will converge before flowing out of said outlet hole 30*b*, the inlet hole of the inlet plate 121, and the water through hole between the inlet plate 121 and the diverter plate 122 then flow towards the face cover assembly, to make water outlet from the first showerhead 10. During this time if open the control mechanism 70 of the second showerhead 20, the second showerhead 20 will be with water outlet as well, as FIG. 10, FIG. 11 shown.

Figure 12:
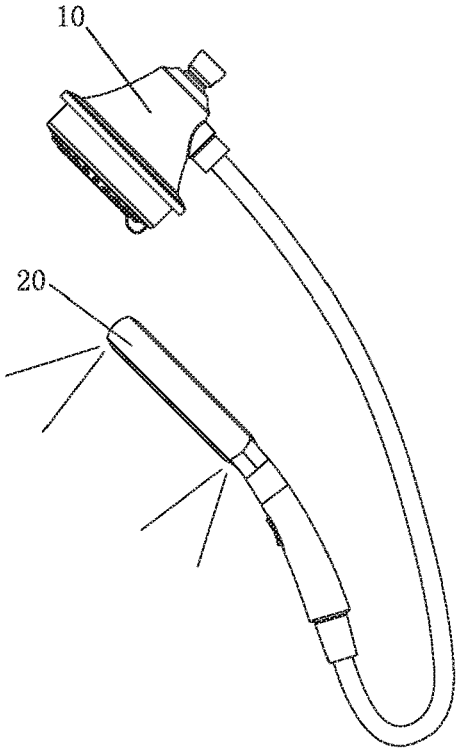
FIG. 12 illustrates a state diagram of the present invention in embodiment 1 when the first showerhead is in stop water flowing status while the second showerhead is in water outlet status.
Figure 13:
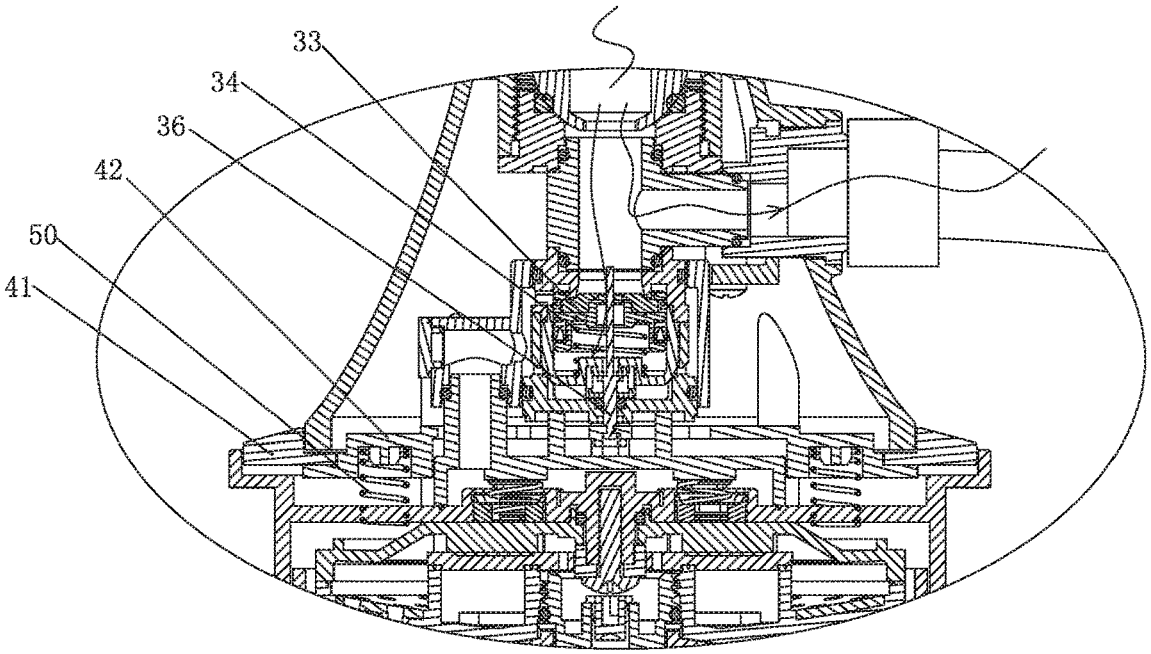
FIG. 13 illustrates a partial sectional diagram of the present invention in embodiment 1 when the first showerhead is in stop water flowing status while the second showerhead is in water outlet status.

When dispatching the second showerhead 20 from the first showerhead 10, the second magnetic piece 41 will lose magnetic attraction from the first magnetic piece 41, and will upwardly reset with the switch board 42 under the resilience force of the second elastic piece 50, then bring the switch pore 36 to move upwardly, to make the blocking portion 361 of the switch pore 36 to block the pressure relief valve 30*e*. Due to the pores 30*g* of the movable valve core 33 always in the water going through status, the first outlet channel 30*c* will communicate with the pressure relief hole 30*e*, therefore the water pressure in the pressure cavity 30*f* will be kept in balance with the water pressure of inlet hole 30*a*, so that the movable valve core 33 will block said inlet hole 30*a* by the pushing force from the first elastic piece 34, therefore the first outlet channel 30*c* couldn't communicate with the inlet hole 30*a*. At this time, the first outlet channel 30*c* and the second outlet channel 30*d* are both without water outlet, so that the first showerhead 10 will stop water flowing, as FIG. 12, FIG. 13 shown. During this time if operate the control mechanism 70 of the second showerhead 20, the second showerhead 20 will be controlled to be with water outlet or stop water flowing.

Embodiment 2

Figure 14:
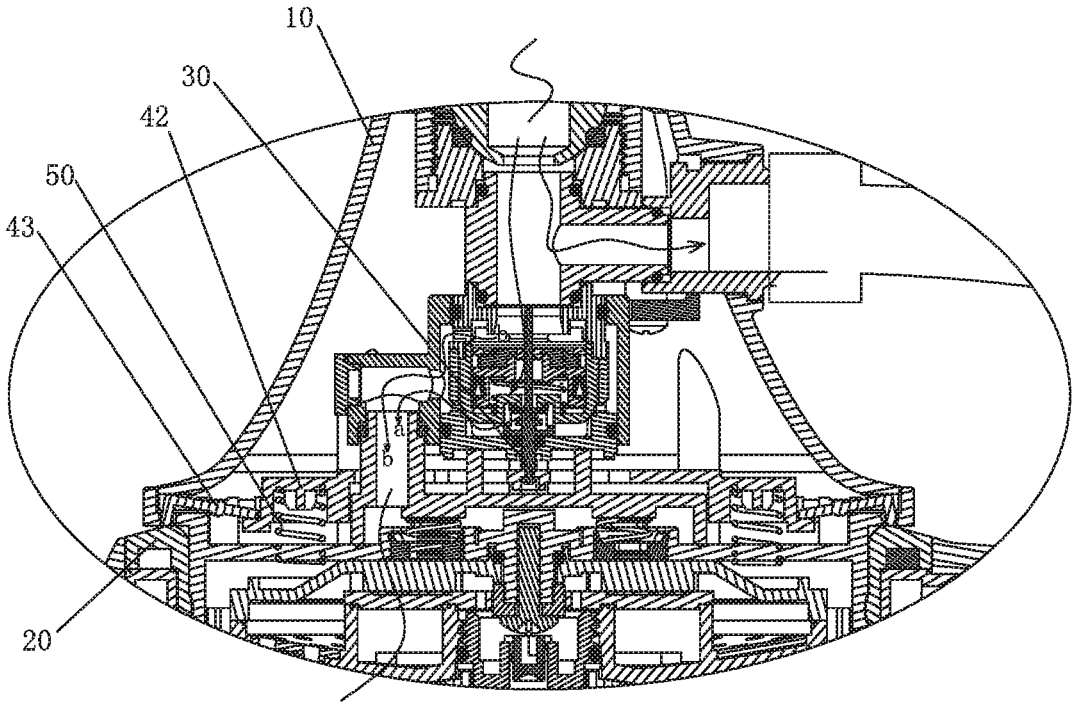
FIG. 14 illustrates a state diagram of the present invention in embodiment 2 when the first showerhead and the second showerhead are both with water outlet.
Figure 15:
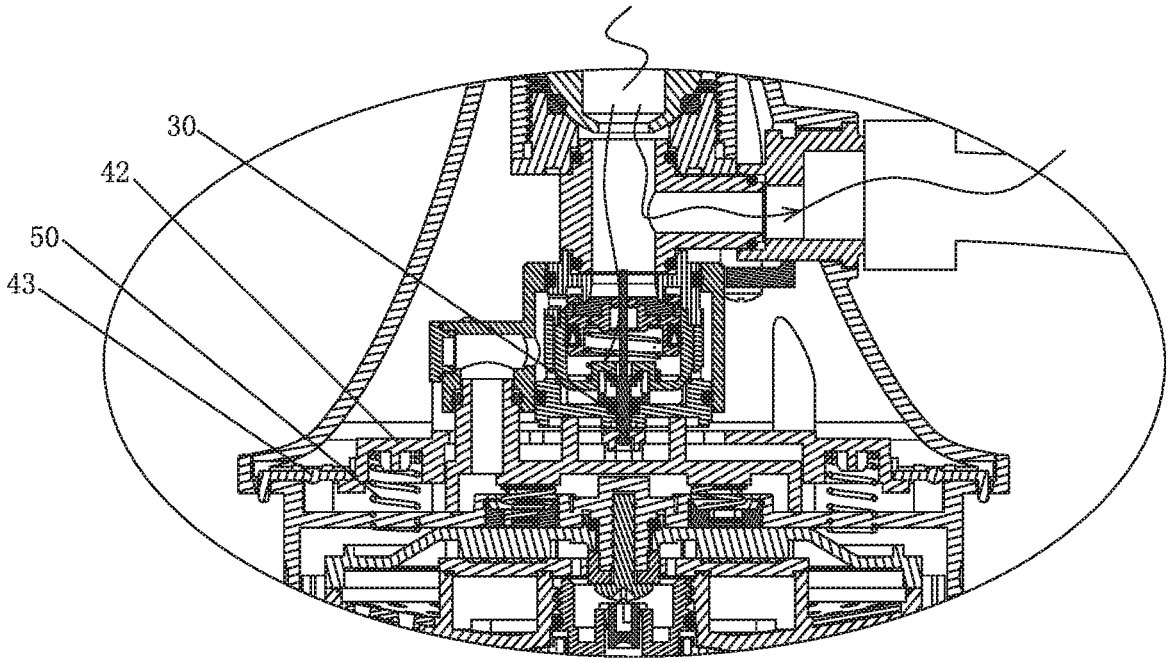
FIG. 15 illustrates a partial sectional diagram of the present invention in embodiment 2 when the first showerhead is in stop water flowing status while the second showerhead is in water outlet status.

As FIG. 14, FIG. 15 shown, the difference from the embodiment 1 mentioned as above is: said control device comprises several control lever 43, switch board 42 and switch mechanism 30, the switch mechanism 30 is set in the first showerhead 10, the switch board 42 is movably installed on the first showerhead 10 and is connected to the switch mechanism 30, the control lever is in rotary connection with the first showerhead 10, when connecting the second showerhead 20 to the first showerhead 10, the second showerhead 20 will push the control lever 43 to rotate, the control lever 43 will drive the motion of the switch mechanism 30 through the switch board 42 to control the water outlet of the first showerhead 10, when dispatching the second showerhead 20 from the first showerhead 10, resetting of the switch board 42 will drive the motion of the switch mechanism 30 to control the first showerhead 10 to stop water flowing. The second showerhead 20 is reset by said second elastic piece 50 which is located between the switch board 42 and the outlet assembly of the first showerhead to push against each other, the second elastic piece 50 is specifically set to be a spring.

In this embodiment, said switch mechanism 30 is set to be pilot valve switch mechanism as mentioned in above embodiment 1, the connection between the switch mechanism 30 and the switch board 42 is same as mentioned in embodiment 1.

A method of making a showerhead combination water outlet in switch way, comprises a non handheld first showerhead and a handheld second showerhead, when connecting the second showerhead to the first showerhead, the first showerhead will be with water outlet, when dispatching the second showerhead from the first showerhead, the first showerhead will stop water flowing.

In this embodiment, said second showerhead is provided with a control device, when connecting the second showerhead to the first showerhead, the second showerhead will drive the motion of the control device to control the water outlet of the first showerhead, when dispatching the second showerhead from the first showerhead, the control device will control the first showerhead to stop water flowing.

In this embodiment, said control device comprises a switch mechanism and a magnetic control unit, the switch mechanism is installed in the first showerhead, the magnetic control unit is movably installed in the first showerhead, said second showerhead is disposed with a first magnetic piece, when connecting the second showerhead to the first showerhead, the first magnetic piece will be magnetically attracted by the magnetic control unit and drive the magnetic control unit to move, then the magnetic control unit will drive the motion of the switch mechanism to control the water outlet of the first showerhead, when dispatching the second showerhead being from the first showerhead, resetting of the magnetic control unit will drive the motion of the switch mechanism to control the first showerhead to stop water flowing. Except that, said control device could also use the control device mentioned in embodiment 1 or other control device.

In this embodiment, said switch mechanism is set to be pilot valve switch mechanism mentioned as above. Said magnetic control unit comprises a second magnetic piece and a switch board mentioned as above. Said first showerhead comprises a shower body and an outlet assembly mentioned as above. Said second showerhead comprises a handheld portion and an outlet head portion mentioned as above. The outlet head portion could be coupled to said outlet assembly.

The method of making a showerhead combination water flowing of the invention, its working principle is mentioned as above, therefore, it will be no further description here.

In other embodiment, said resetting mechanism also comprises a third magnetic piece, and magnetic attraction between the third magnetic piece and the second magnetic piece than is less than magnetic attraction between the first magnetic piece and the second magnetic piece, so that when connecting the second showerhead to the first showerhead, the magnetic control unit will be attracted by the first magnetic piece then move downwardly.

In other embodiment, the connection between the second showerhead and the first showerhead could take the way of clasping or thread connecting to realize detachable connection, instead of depending on magnetic attraction between the first magnetic piece and the magnetic control unit, or depending on the coupling relationship between the second showerhead and the first showerhead.

In other embodiment, said switch mechanism is set to be other mechanical switch mechanism or electrical switch mechanism triggered by magnetic control unit.

In other embodiment, said control device is an optical induction control device or an infrared induction control device or an electric switch control device triggered by the second showerhead or other non-lever mechanical control device triggered by the second showerhead.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. A showerhead combination, comprising:
- a first showerhead that is non-handheld;
- a second showerhead that is handheld; and
- a control device that is disposed within the first showerhead, wherein the control device comprises:
  - a switching mechanism; and
  - a magnetic control unit that is movably disposed within the first showerhead to control when water flows out from the first showerhead, wherein:
    - the second showerhead comprises a first magnetic piece,
    - when the second showerhead is connected to the first showerhead, the first magnetic piece is magnetically attracted with the magnetic control unit and drives the magnetic control unit to switch the switching mechanism to cause the water to flow out from the first showerhead, and
    - when the second showerhead is disconnected from the first showerhead, the magnetic control unit is reset and drives motion of the switching mechanism to stop the water from flowing out from the first showerhead.

2. The showerhead combination according to claim 1, wherein:
- the first showerhead comprises a water inlet end and a first water outlet end,
- the switching mechanism is a pilot valve switching mechanism that has defined therein at least one inlet hole and at least one outlet hole, and
- the switching mechanism is disposed in the first showerhead such that one inlet hole of the at least one inlet hole is connected to the water inlet end of the first showerhead and one outlet hole of the at least one outlet hole is connected to the first water outlet end of the first showerhead.

3. The showerhead combination according to claim 2, wherein the pilot valve switching mechanism comprises:
- a fixing unit that is disposed with a first outlet channel, a second outlet channel, and a pressure relief hole, wherein the fixing unit has defined therein the at least one inlet hole and the at least one outlet hole such that the first outlet channel and the second outlet channel are connected to a same outlet hole of the at least one outlet hole or respectively connected to one outlet hole of the at least one outlet hole, the at least one inlet hole is in communication with the first outlet channel, and the pressure relief hole is in communication with the second outlet channel;
- a movable valve core that is slidably connected within the fixing unit in a water inflow direction, wherein:
  - the movable valve core cooperates with the fixing unit to form a pressure cavity, and
  - the movable valve core is disposed with a plurality of pores that communicate with the at least one inlet hole so that the plurality of pores and the pressure relief hole communicate with the pressure cavity; and
- a switching pole that has an outer end connected to the magnetic control unit, wherein:
  - the switching pole is axially movably disposed within the pressure relief hole of the fixing unit, and
  - axial movement of the switching pole opens and closes the pressure relief hole so as to control water pressure inside the pressure cavity which drives the movable valve core to slide for opening or closing the at least one inlet hole.

4. The showerhead combination according to claim 3, wherein:
- the pilot valve switching mechanism further comprises a first elastic piece in the pressure cavity, and
- the first elastic piece is disposed between the movable valve core and the fixing unit and causes the movable valve core and the fixing unit to engage one another.

5. The showerhead combination according to claim 2, wherein:
- the first showerhead comprises a shower body in which is disposed the switching mechanism and the water inlet end, and
- the magnetic control unit is movably disposed on a water outlet assembly of the first showerhead.

6. The showerhead combination according to claim 5, wherein:
- the second showerhead comprises a handheld portion and a water outlet head portion,
- the water outlet head portion has an annular shape, the water outlet head portion is coupled to the water outlet assembly, and the first magnetic piece is disposed within the water outlet head portion.

7. The showerhead combination according to claim 5, wherein:

the water outlet assembly comprises:

an inlet plate comprising an inlet aperture connected to the pilot valve switching mechanism;

a diverter plate that is fixed to the inlet plate in an up and down manner to form a water-through cavity in communication with the inlet aperture; and a face cover assembly comprising at least two water outlet settings, the face cover assembly is rotationally connected to the diverter plate so that rotation of the face cover assembly with respect to the diverter plate causes a water outlet setting of the at least two water outlet settings to change in a switching manner, and the magnetic control unit is movably disposed on the inlet plate.

8. The showerhead combination according to claim 2, wherein:

the first showerhead comprises a diverter assembly, the diverter assembly comprises:

a main inlet hole in communication with the water inlet end of the first showerhead;

a first diverter hole connected to the pilot valve switching mechanism to supply the water to the pilot valve switching mechanism; and a second diverter hole connected to the second showerhead through a water inlet tube.

9. The showerhead combination according to claim 1, wherein:

the magnetic control unit comprises a switching board and a second magnetic piece, the second magnetic piece is magnetically attracted to the first magnetic piece, the second magnetic piece is disposed on the switching board, the switching board is movably fixed to the first showerhead and is connected to the switching mechanism, and the first showerhead comprises a resetting mechanism to drive the magnetic control unit to reset.

10. The showerhead combination according to claim 9, wherein:

the resetting mechanism comprises at least one second elastic piece, and the at least one second elastic piece is disposed between the magnetic control unit and a water outlet assembly of the first showerhead and causes the magnetic control unit and the water outlet assembly to engage one another.

11. The showerhead combination according to claim 9, wherein:

the first showerhead comprises a water inlet end and a water outlet assembly, the first showerhead comprises a shower body in which is disposed the switching mechanism and the water inlet end, and the magnetic control unit is movably disposed on the water outlet assembly.

12. The showerhead combination according to claim 11, wherein:

the water outlet assembly comprises:

an inlet plate comprising an inlet aperture connected to the switching mechanism;

a diverter plate that is fixed to the inlet plate in an up and down manner to form a water-through cavity in communication with the inlet aperture; and a face cover assembly comprising at least two water outlet settings, the face cover assembly is rotationally connected to the diverter plate so that rotation of the face cover assembly with respect to the diverter plate causes a water outlet setting of the at least two water outlet settings to change in a switching manner, and the magnetic control unit is movably disposed on the inlet plate.

13. The showerhead combination according to claim 1, wherein:

the first showerhead comprises a water inlet end, a first water outlet end, and a water outlet assembly, the first showerhead comprises a shower body in which is disposed the switching mechanism and the water inlet end, the first water outlet end is disposed on the water outlet assembly, and the magnetic control unit is movably disposed on the water outlet assembly.

14. The showerhead combination according to claim 13, wherein:

the second showerhead comprises a handheld portion and a water outlet head portion, the water outlet head portion has an annular shape, the water outlet head portion is coupled to the water outlet assembly, and the first magnetic piece is disposed within the water outlet head portion.

15. The showerhead combination according to claim 13, wherein:

the water outlet assembly comprises:

an inlet plate comprising an inlet aperture connected to the switching mechanism;

a diverter plate that is fixed to the inlet plate in an up and down manner to form a water-through cavity in communication with the inlet aperture; and a face cover assembly comprising at least two water outlet settings, the face cover assembly is rotationally connected to the diverter plate so that rotation of the face cover assembly with respect to the diverter plate causes a water outlet setting of the at least two water outlet settings to change in a switching manner, and the magnetic control unit is movably disposed on the inlet plate.

16. The showerhead combination according to claim 1, wherein:

the first showerhead comprises a diverter assembly, and the diverter assembly comprises:

a main inlet hole in communication with a water inlet end of the first showerhead;

a first diverter hole connected to the switching mechanism to supply the water to the switching mechanism; and a second diverter hole connected to the second showerhead through a water inlet tube.

17. A method for controlling water flow from the showerhead combination according to claim 1, the method comprising:

connecting the second showerhead to the first showerhead to cause the water to flow out from the first showerhead; and disconnecting the second showerhead from the first showerhead to cause the water to stop flowing out from the first showerhead.

18. The method according to claim 17, wherein:

when connecting the second showerhead to the first showerhead, the connection drives the control device to cause the water to flow out from the first showerhead, and when disconnecting the second showerhead from the first showerhead, the control device causes the water to stop flowing out from the first showerhead.

* * * * *